US005819817A

United States Patent [19]

Van Nest

[11] Patent Number: 5,819,817

[45] Date of Patent: Oct. 13, 1998

[54] DUMMY BOTTLE FOR THE FLUSHING CYCLE IN A FILLING MACHINE

[75] Inventor: Yvon Van Nest, Ozzano Taro, Italy

[73] Assignee: Procomac S.p.A., Sala Baganza, Italy

[21] Appl. No.: 770,304

[22] Filed: Dec. 20, 1996

[30] Foreign Application Priority Data

Dec. 22, 1995 [IT] Italy ..... PR95 A 000037

[51] Int. Cl.[6] ..... B65B 1/04

[52] U.S. Cl. ..... 141/91; 141/89; 141/90; 141/147; 141/148; 141/150; 141/275

[58] Field of Search ..... 141/91, 85, 89, 141/90, 129, 147, 148, 150, 151, 172, 275

[56] References Cited

U.S. PATENT DOCUMENTS 5,095,958 3/1992 Tincati ..... 141/89

FOREIGN PATENT DOCUMENTS 0 568 121 11/1993 European Pat. Off. .
0 597 161 5/1994 European Pat. Off. .
93 19 866 3/1995 Germany .

*Primary Examiner*—Robert M. Fetsuga
*Assistant Examiner*—Timothy L. Maust
*Attorney, Agent, or Firm*—Oblon, Spivak, McClelland, Maier & Neustadt, P.C.

[57] ABSTRACT

A dummy bottle having a duct through which a flushing fluid flows when the dummy bottle is sealingly coupled with a tap. The dummy bottle is actuated during the flushing cycle of a filling machine used in a bottling plant. Whether in a rest position or in an active position, the dummy bottle is positioned higher than a corresponding neck supporting element in the filling machine.

20 Claims, 2 Drawing Sheets

DUMMY BOTTLE FOR THE FLUSHING CYCLE IN A FILLING MACHINE

BACKGROUND OF THE INVENTION

The present invention relates to a dummy bottle for the flushing cycle in a filling machine.

In machines for filling containers with liquids, when it is necessary to perform periodic flushing, i.e. hygienic cleaning of the filling valves and all the zones which come into contact with the filling liquid, use is made of dummy bottles, i.e. objects which simulate the presence of the container underneath the filling valve and allow the carrying out of a normal filling cycle in which a flushing liquid is used instead of the filling liquid.

IT 1,234,001 discloses a rotating filling machine in which each filling valve incorporates means for supporting a dummy bottle.

Said machine comprises a fixed frame and structure movable vertically so as to bring a bottle or a dummy bottle opposite the filling valve by means of an engaging element. The dummy bottle is rigidly fixed to a rotating arm which may be rotated between an operating position in which it positions the dummy bottle on the engaging element aligned with the filling valve and a rest position in which the dummy bottle is outside of the path followed by the bottles.

The rotating arm is connected to a sleeve which is able to slide and rotate on a column of the movable structure and means are provided for retaining the dummy bottle, when in the rest condition, in a position substantially alongside the filling valve.

A drawback of the aforementioned design consists in the fact that the dummy bottle, being positioned laterally with respect to the filling valve in the rest condition, requires necessarily a greater interval between two filling valves, for the same circumference of the rotating filling machine.

A further drawback consists in the absence of a return circuit for the flushing liquid and in the fact that compressed air is introduced in order to empty the dummy bottle of the flushing liquid.

DE 3,722,495 illustrates a filling machine in which each filling valve is provided with a dummy bottle which rotates about a horizontal axis in order to assume an operating position, and is associated with means for raising the bottles.

This solution has the drawback of dripping of the dummy bottle since the latter, in the rest position, is arranged upside down.

DE 2,804,423 illustrates a filling machine in which sealing elements are brought opposite the filling valve during the washing phases.

In these latter documents also, there is the absence of a circuit for the flushing liquid, since they relate to isobaric filling machines which comprise a duct for the introduction or return of the air inside the filling valve, which is used for the outward or return conveying of the flushing agent during the flushing phases.

EP 0597161 discloses a cleaning device in which the dummy bottle is brought under the filling valve through a rotation about a horizontal axis. Said device can not be used for filling machines which have to fill plastic PET container provided with a projecting neck, if these machines have fixed means to support the projecting neck of the container. The fixed supporting means make necessary the use of a non-rotating dummy bottle.

If the means which support the projecting neck are movable means, they are elevator means which shift the container towards the filling valve with an up-and-down movement.

EP 0568121 discloses a device for cleaning a filling machine in which a flexible pipe is used to create a circuit for the passage of a cleaning fluid.

Special means are necessary to support and move the dummy bottle, because the flexible pipe does not support the dummy bottle.

DE-U-9319866 discloses another cleaning device which comprises a dummy bottle and which makes necessary the use of special means to support and move the dummy bottle.

SUMMARY OF THE INVENTION

The object of the present invention is that of eliminating the aforementioned drawbacks and providing a dummy bottle in a filling machine and an associated flushing method which enable the maximum use to be made of the space available in the machine and make it possible to provide a circuit for circulation of the flushing fluid which is able to perform a flushing cycle even at a pressure greater than the ambient pressure and can be used also with filling valves provided with only the pipe for supplying the filling liquid.

A further object is to provide a dummy bottle which, together with its circuit, incorporates means for supporting and moving the dummy bottle.

Another object is to provide a dummy bottle which can be placed between the valve and the support of the projecting neck of the container to be filled.

Said objects are fully achieved by the dummy bottle according to the present invention, in which the dummy bottle is provided with a duct for circulation of flushing fluid and with sealing elements intended to be coupled with the bottom end of the filling valve so as to permit a flushing cycle at a pressure greater than the ambient pressure.

Cams are provided for effecting lowering of the dummy bottle, the translatory movement underneath the filling valve, raising towards the valve and subsequent lowering and return into the rest position.

BRIEF DESCRIPTION OF THE DRAWINGS

These and other characteristic features will emerge more clearly from the following description of a preferred embodiment illustrated, purely by way of a non-limiting example, in the accompanying illustrative plates, in which.

DESCRIPTION OF THE PREFERRED EMBODIMENTS

Figure 2:
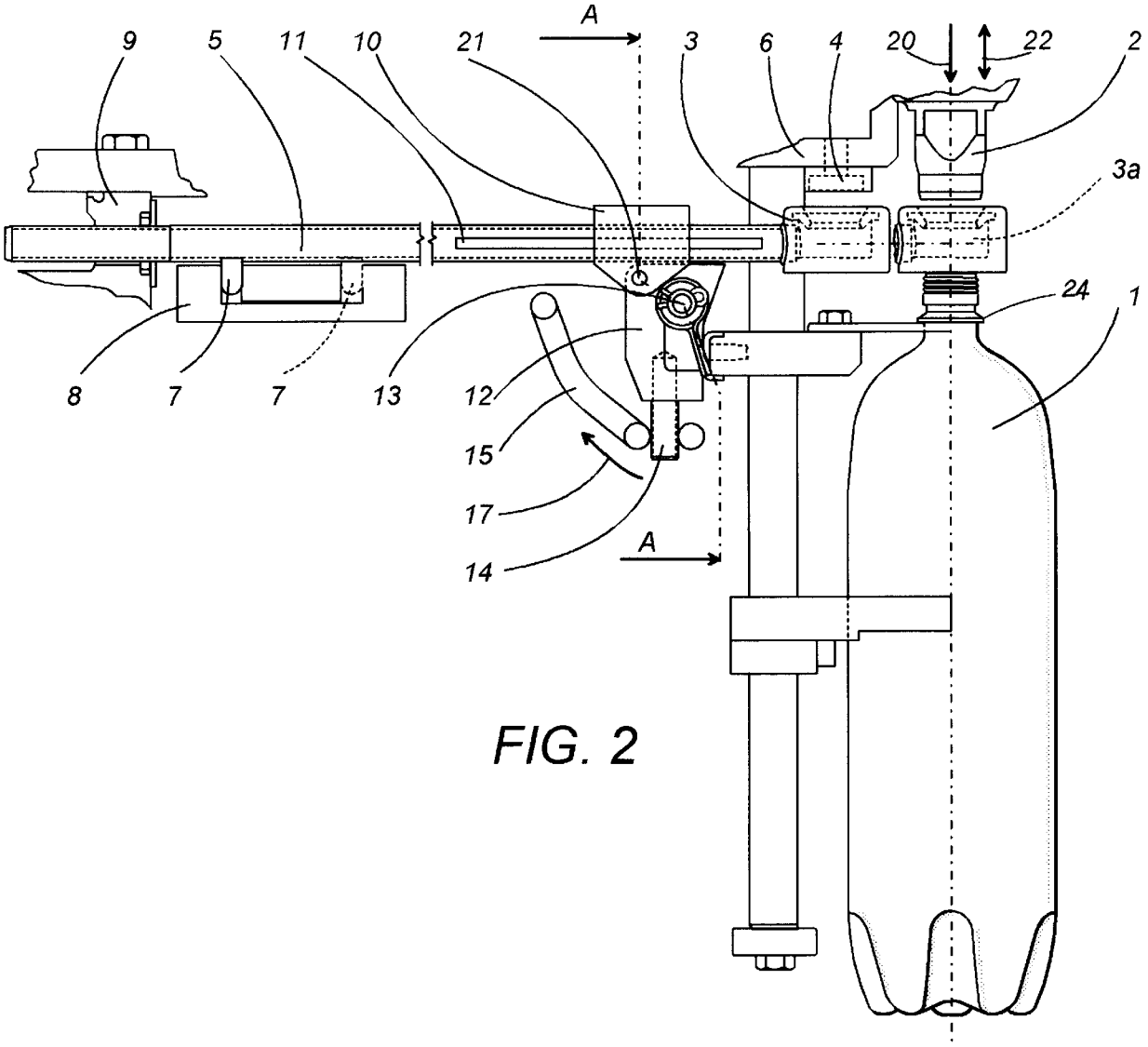
Figure 3:
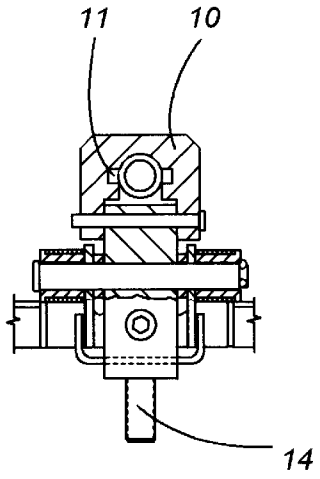
FIG. 3 shows a cross-section of the device along A—A of FIG. 2.

With reference to the FIG. 2 a container 1 which, in a rotating filling machine of the known type, is filled with liquid by means of a filling valve or tap 2 without any seal being provided between the mouth of the container and the tap, so that the air expelled from the container during filling escapes into the surrounding environment.

The container 1 is provided with a projecting neck 24 and is supported by fixed supporting means 25, for example a fork.

A dummy bottle (or washing container) 3 which, in the rest condition, is mounted on a support 4 formed as the bottom end of the tap 2, so as to act as a stopper for the dummy bottle. The support 4 is rigidly fixed to a frame 6 of the filling machine.

The dummy bottle 3 is provided with a rigid duct 5 through which flushing fluid is circulated during the machine washing phases.

The duct 5 constitutes both supporting means and moving means for the dummy bottle 3.

The dummy bottle 3 is shaped in such a way as to be placed, either when in an active position or when in rest position, at a level which is higher than the level of the supporting means 25 for the projecting neck 24 of the container 1.

The duct 6 is provided with a projection 7 acted on by a cam 8 which causes the translatory movement of the duct 5 along its own axis inside support guides 9 and 10.

The duct 5 is provided with anti-rotational elements which, in FIG. 2, consist of lateral lugs 11 which slide in corresponding grooves of the guide 10 and which have the purpose of preventing rotational movements of the duct 5 about its longitudinal axis.

The dummy bottle 3 is provided internally with a gasket 18 (FIG. 1) designed to form a seal against the tap 2 and, alternately, against the support 4.

While the guide 9 is rigidly fixed to the rotating frame of the filling machine, the guide 10 is movable with respect thereto, being operated by a lever mechanism consisting of a block 12 on which the guide 10 is pivotably hinged. The block 12 is in turn able to rotate about a fixed pin 13.

Figure 1:
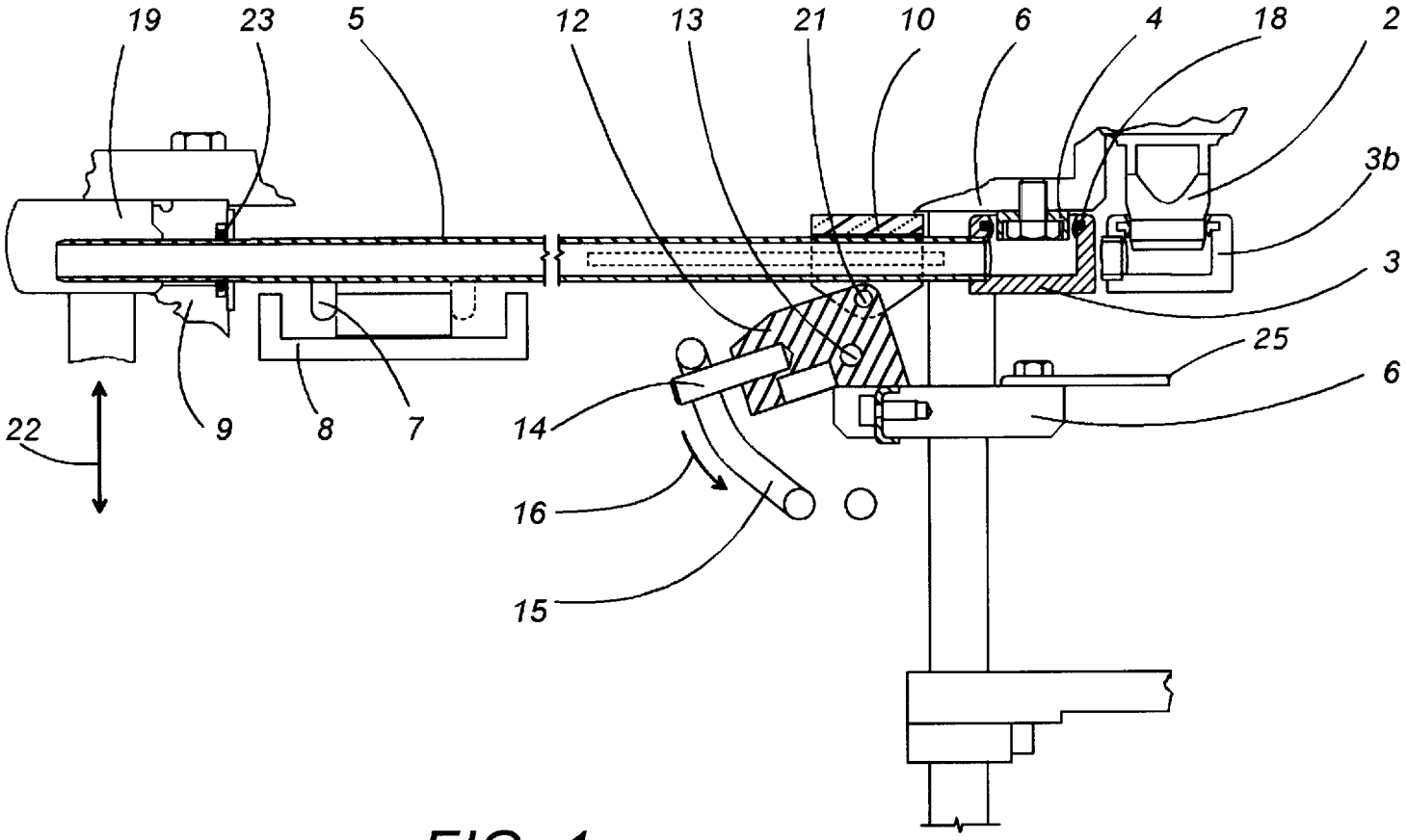
FIGS. 1 and 2 illustrate the device for actuating the dummy bottle in two different operating conditions.

The block 12 is in fact provided with a stud 14 which, during rotation of the filling machine, is displaced by a cam which causes movement of the block 12 from the position illustrated in FIG. 1, where the guide 10 is situated in the fully raised position, to the position illustrated in FIG. 2, where the guide 10 is situated at a lower level such as to allow the translatory movement of the duct 5 and the dummy bottle without any interference with the support 4 and with the tap 2.

In the position shown in FIG. 1, the fulcrum 21 is located beyond the top dead centre of the block 12, which rests on the frame 6 of the filling machine. With this excellent mechanical solution, during the flushing cycle, the dummy bottle is prevented from being lowered even when there is strong pressure exerted by the flushing liquid on the dummy bottle itself.

The guides 9 and 10, together with the cams 8 and 15 and the projection 7, the stud 14 and the block 12 together form a device for actuating a dummy bottle.

Each tap of the filling machine has associated with it a dummy bottle and an associated actuating device.

According to the method for actuating the dummy bottle, when it is required to perform a filling-machine flushing cycle, a normal filling cycle is substantially simulated with the filling machine rotating, having flowing through it, in place of the filling liquid, a flushing fluid which, instead of filling the containers, enters the dummy bottles and flows into the ducts 5—one for each tap—which converge into a header 19.

A sealing element 23 is provided for each duct 5.

When it is necessary to perform a flushing cycle, the cams 8 and 15 are displaced into an active position by actuator means, not illustrated since they are of a type which is substantially known.

The first cam 15 causes displacement of the stud 14 in the direction indicated by an arrow 16, causing rotation of the block 12 about the pin 13 and consequent lowering of the guide 10 and hence the dummy bottle which is lowered underneath the zone of interference with the support 4 and with the tap 2.

At this point the second cam 8 intervenes and displaces the projection 7, causing forward movement of the duct 5 and bringing the dummy bottle coaxially underneath the tap (position 3*a* of FIG. 2).

The first cam 15 displaces the stud 14, moving it in the direction of the arrow 17 and causing raising of the dummy bottle until it forms a seal with the tap (position 3*b* in FIG. 1).

At this point, flushing may be activated and the flushing fluid may flow in the normal direction of the filling liquid, indicated by the arrow 20, from the tap towards the dummy bottle and hence towards the outlet duct 5, or it may flow in the opposite direction and enter the dummy bottle via the duct 5, flowing out then through the tap.

The flushing liquid may therefore flow in two directions, as illustrated by the arrow 22, namely it may flow in the same direction or opposite direction. All this may occur at the ambient pressure or higher.

At the end of the flushing cycle the first cam 15 moves the stud 14 in the direction of the arrow 16, causing lowering of the dummy bottle; the cam 8 then intervenes and causes retraction of the duct 5, followed finally by the cam 15 again which causes raising of the dummy bottle into the rest position associated with the support 4.

With the present device it is possible to maintain a sufficiently small interval between the taps of the filling machine, even though they are provided with dummy bottles; in fact, the latter are not positioned laterally with respect to the tap, but in a position at the rear of the latter.

A further advantage is represented by the presence of ducts through which the flushing fluid flows, the latter being able to be introduced at a pressure higher than the ambient pressure.

The particular hinging arrangement between the guide 10 and block 12 ensures moreover a perfect seal between the dummy bottle 3 and tap 2 even in the presence of intense pressures during the flushing cycle.

What is claimed:

1. A dummy bottle for receiving flushing fluid in a container-filling machine having a plurality of taps and having a plurality of fixed neck supporting elements for the projecting necks of containers to be filled, comprising:

a rigid duct inside which the flushing fluid flows when the dummy bottle is sealingly coupled with a respective tap from among the plurality of taps, the rigid duct being configured to support and move the dummy bottle, wherein the dummy bottle is configured to be displaceable automatically from a rest position to an active position during a flushing cycle, said rest position and said active position being higher than the level of a respective fixed neck supporting element from among said plurality of fixed neck supporting elements of the filling machine.

2. A dummy bottle according to claim 1, further comprising:

an actuating device, said actuating device including a movable guide for the rigid duct, which is raised and lowered by a lever mechanism having two distinct work positions and means configured to shift the rigid duct along the movable guide between a position corresponding to the dummy bottle being located at the rear of the tap and a position corresponding to the dummy bottle being coaxial to the tap; one of the two work positions of the lever permitting said shifting of the duct, the other work position of the lever being associated with both the rest position of the dummy bottle and the active position of the dummy bottle when coupled to the tap.

3. A dummy bottle according to claim 2, wherein the lever mechanism is actuated by a first cam and there is a second cam which, displacing a projection of the duct, causes translation of the duct from a position where the dummy bottle is located at the rear of the tap into a position where it is coaxial with the tap, and vice versa.

4. A dummy bottle according to claim 1, wherein the duct is provided with anti-rotational elements for preventing the rotation of the duct about its longitudinal axis.

5. A dummy bottle according to claim 2, wherein the lever mechanism actuating the guide is formed so that when the guide is located in the fully raised position and the dummy bottle is sealingly coupled with the tap, lowering of the dummy bottle is mechanically prevented.

6. A dummy bottle according to claim 5, wherein said lever mechanism comprises of a block rotating about a fixed pin when actuated by a first cam until it rests against a frame of the filling machine, a fulcrum connecting the guide and block being situated beyond the top dead center of the said block when the block rests against the frame.

7. Rotating machine for filling liquids into containers, comprising at least one dummy bottle in accordance with claim 1.

8. A dummy bottle for receiving flushing fluid in a container-filling machine having a plurality of taps and having a plurality of fixed neck supporting means for supporting the projecting necks of containers to be filled, said dummy bottle comprising:

rigid flow means for supporting and moving the dummy bottle and for receiving the flushing fluid when the dummy bottle is sealingly coupled with a respective tap from among the plurality of taps, wherein the dummy bottle is configured to be displaceable automatically from a rest position to an active position during a flushing cycle, said rest position and said active position being higher than the level of a respective fixed neck supporting means from among said plurality of fixed neck supporting means of the filling machine.

9. A dummy bottle according to claim 8, further comprising:

an actuating means for guiding and moving the rigid flow means, said actuating means including a movable guide means for guiding the rigid flow means, a lever means having first and second work positions for raising and lowering the moveable guide means, and shifting means for shifting the duct along the movable guide between a first position corresponding to the dummy bottle being located at the rear of the tap and a second position corresponding to the dummy bottle being coaxial to the tap, one of the first and second work positions of the lever means permitting said shifting of the rigid flow means, the other of the first and second work positions of the lever means corresponding to both the rest position of the dummy bottle and the active position of the dummy bottle.

10. A dummy bottle according to claim 9, further comprising:

first cam means for actuating the lever means; and second cam means for displacing a projection of the rigid flow means and causing translation of the rigid flow means between a first position corresponding to the dummy bottle being located at the rear of the tap and a second position corresponding to the dummy bottle being coaxial with the tap.

11. A dummy bottle according to claim 8, wherein the rigid flow means comprises:

anti-rotational means for preventing the rotation of the rigid flow means about the longitudinal axis of the rigid flow means.

12. A dummy bottle according to claim 9, wherein the lever means comprises:

locking means for mechanically preventing the dummy bottle from being lowered when the guide means is located in the fully raised position and the dummy bottle is sealingly coupled with the tap.

13. A dummy bottle according to claim 12, wherein said lever means comprises:

a block means for rotating about a fixed pin when actuated by a first cam until the block means rests against a frame of the filling machine; and a fulcrum means for connecting the movable guide means and block means, said fulcrum means being situated beyond the top dead center of said block means when the block means rests against the frame.

14. A rotating machine for filling liquids into containers, comprising at least one dummy bottle in accordance with claim 8.

15. A filling machine for filling containers and dispensing a flushing fluid during a flushing cycle, said filling machine comprising:

an at least one tap;

an at least one fixed neck supporting element for supporting the projecting necks of containers to be filled; and a dummy bottle configured to receive the flushing fluid from the tap during a flushing cycle, said dummy bottle including a rigid duct inside which the flushing fluid flows when the dummy bottle is sealingly coupled with said at least one tap, the rigid duct being configured to support and move the dummy bottle, wherein the dummy bottle is configured to be displaceable automatically from a rest position to an active position to receive flushing fluid from the at least one tap during the flushing cycle, said rest position and said active position being higher than the level of the at least one fixed neck supporting element of the filling machine.

16. A filling machine according to claim 15, wherein the dummy bottle further comprises:

an actuating device, said actuating device including a movable guide for the rigid duct, a lever mechanism configured to raise and lower the moveable guide, said lever mechanism having first and second work positions corresponding to the raising and lowering of the movable guide, and shifting device configured to shift the rigid duct along the movable guide between a first position corresponding to the dummy bottle being located at the rear of the tap and a second position corresponding to the dummy bottle being coaxial to the tap, one of said first and second work positions of the lever permitting the rigid duct to shift, the other of said first and second work positions of the lever corresponding to both the rest position of the dummy bottle and the active position of the dummy bottle.

17. The filling machine according to claim 16, wherein the dummy bottle further comprises:

a first cam configured to actuate the lever mechanism; and a second cam configured to displace a projection of the rigid duct and cause translation of the rigid duct between a first position corresponding to the dummy bottle being located at the rear of the at least one tap and a second position corresponding to the dummy bottle being coaxial with the at least one tap.

18. A filling machine according to claim 15, wherein the rigid duct comprises:

an anti-rotational mechanism configured to prevent the rotation of the duct about the longitudinal axis of the rigid duct.

19. A filling machine according to claim 16, wherein said lever mechanism comprises:

a locking device configured to mechanically prevent the dummy bottle from being lowered when the movable guide is located in the fully raised position and the dummy bottle is sealingly coupled with the at least one tap.

20. A filling machine according to claim 19, wherein said lever mechanism comprises:

a block configured to rotate about a fixed pin when actuated by a first cam until the block rests against a frame of the filling machine; and a fulcrum connecting the movable guide and the block, said fulcrum being situated beyond the top dead center of said block when the block rests against the frame.

* * * * *

UNITED STATES PATENT AND TRADEMARK OFFICE

CERTIFICATE OF CORRECTION

PATENT NO. : 5,819,817

DATED : October 13, 1998

INVENTOR(S) : Yvon Van NESTE

It is certified that error appears in the above-identified patent and that said Letters Patent is hereby corrected as shown below:

On the Title page, Item [75], the inventor's name should be:

--Yvon Van Neste--

Signed and Sealed this

Eleventh Day of May, 1999

*Attest:*

*Attesting Officer*

Q. TODD DICKINSON

*Acting Commissioner of Patents and Trademarks*